US011098548B2

(12) United States Patent
Samuel et al.

(10) Patent No.: US 11,098,548 B2
(45) Date of Patent: Aug. 24, 2021

(54) DRILLSTRING WITH A BOTTOM HOLE ASSEMBLY HAVING MULTIPLE AGITATORS

(71) Applicant: Landmark Graphics Corporation, Houston, TX (US)

(72) Inventors: Robello Samuel, Cypress, TX (US); Yuan Zhang, Missouri City, TX (US)

(73) Assignee: Landmark Graphics Corporation, Houston, TX (US)

( * ) Notice: Subject to any disclaimer, the term of this patent is extended or adjusted under 35 U.S.C. 154(b) by 36 days.

(21) Appl. No.: 16/495,706

(22) PCT Filed: Jun. 16, 2017

(86) PCT No.: PCT/US2017/037844
§ 371 (c)(1),
(2) Date: Sep. 19, 2019

(87) PCT Pub. No.: WO2018/231244
PCT Pub. Date: Dec. 20, 2018

(65) Prior Publication Data

US 2021/0102435 A1 Apr. 8, 2021

(51) Int. Cl.
*E21B 31/00* (2006.01)
*E21B 7/04* (2006.01)
*E21B 47/09* (2012.01)

(52) U.S. Cl.
CPC ..... *E21B 31/005* (2013.01); *E21B 7/046* (2013.01); *E21B 47/09* (2013.01)

(58) Field of Classification Search
CPC ..... E21B 31/005; E21B 47/09; E21B 7/046; E21B 7/24
See application file for complete search history.

(56) References Cited

U.S. PATENT DOCUMENTS 4,384,625 A * 5/1983 Roper ..... E21B 7/04 175/56
4,890,682 A * 1/1990 Worrall ..... E21B 4/02 175/106
9,222,312 B2 * 12/2015 Anderson ..... E21B 28/00
(Continued)

FOREIGN PATENT DOCUMENTS

WO WO2015/094174 * 6/2015 ..... A21B 7/04
WO 2017027960 A1 2/2017

OTHER PUBLICATIONS

FR Application Serial No. 1854000; Office action; dated Nov. 2, 2018, 2 pages.

(Continued)

*Primary Examiner* — Christopher J Sebesta
(74) *Attorney, Agent, or Firm* — Gilliam IP PLLC

(57) ABSTRACT

A method comprising determining a property of a first section of drill pipe that is to connect a first agitator to a second agitator in a bottom hole assembly of a drill string, determining a distance between the first agitator and the second agitator based, at least in part, on the property of the first section of drill pipe, positioning the first agitator in the bottom hole assembly of the drill string, and positioning the second agitator in the bottom hole assembly of the drill string relative to the first agitator based, at least in part, on the distance.

20 Claims, 10 Drawing Sheets

(56) References Cited

U.S. PATENT DOCUMENTS

| | | | | |
|---|---|---|---|---|
| 2010/0212901 | A1* | 8/2010 | Buytaert | E21B 7/24 166/286 |
| 2012/0048619 | A1 | 3/2012 | Seutter et al. | |
| 2014/0069639 | A1* | 3/2014 | Mackenzie | E21B 41/0085 166/250.01 |
| 2018/0163495 | A1* | 6/2018 | Kinsella | E21B 7/04 |

OTHER PUBLICATIONS

PCT Application No. PCT/US2017/037844, International Search Report, dated Dec. 19, 2017, 3 pages.
PCT Application No. PCT/US2017/037844, International Written Opinion, dated Dec. 19, 2017, 10 pages.

* cited by examiner

DRILLSTRING WITH A BOTTOM HOLE ASSEMBLY HAVING MULTIPLE AGITATORS

BACKGROUND

The disclosure generally relates to the field of downhole drilling, and more particularly to downhole drilling using a drill pipe configured with multiple agitators.

Some oil and gas wellbore profiles include a horizontal wellbore (alternately referred to as lateral wellbores) extending from a vertical wellbore to increase the interface or surface area with the producing formation. As the length of the horizontal wellbore increases, friction or sticking force on a drill pipe being advanced within the horizontal wellbore increases. The friction is due to contact between the wall of the wellbore and drill pipe. As the length of the drill pipe increases, the portion of the drill pipe engaging the wall of the wellbore also increases, thus increasing the friction. The friction may also increase due to build-up of solid materials around the drill pipe.

Agitators, also known as downhole pulse generating devices or axial oscillation tools, are sometimes coupled to the drill pipe to create fluctuations in fluid pressure that result in the drill pipe vibrations. The vibrations help maintain movement of the drill pipe, which is desirable during operation since the kinetic friction force is substantially less than the static friction force. The vibrations also help prevent the build-up of solid materials around the drill pipe and prevent the drill pipe from becoming stuck in the well.

As the length of the drill pipe increases, a single agitator may not be sufficient to minimize the friction, thus requiring multiple agitators to be coupled to the drill pipe. However, multiple agitators can result in either interfering or sympathetic vibrations assumed by the drill pipe, reducing the effectiveness of each agitator or damaging the drill pipe.

BRIEF DESCRIPTION OF THE DRAWINGS

Embodiments of the disclosure may be better understood by referencing the accompanying drawings.

DESCRIPTION

Figure 1:
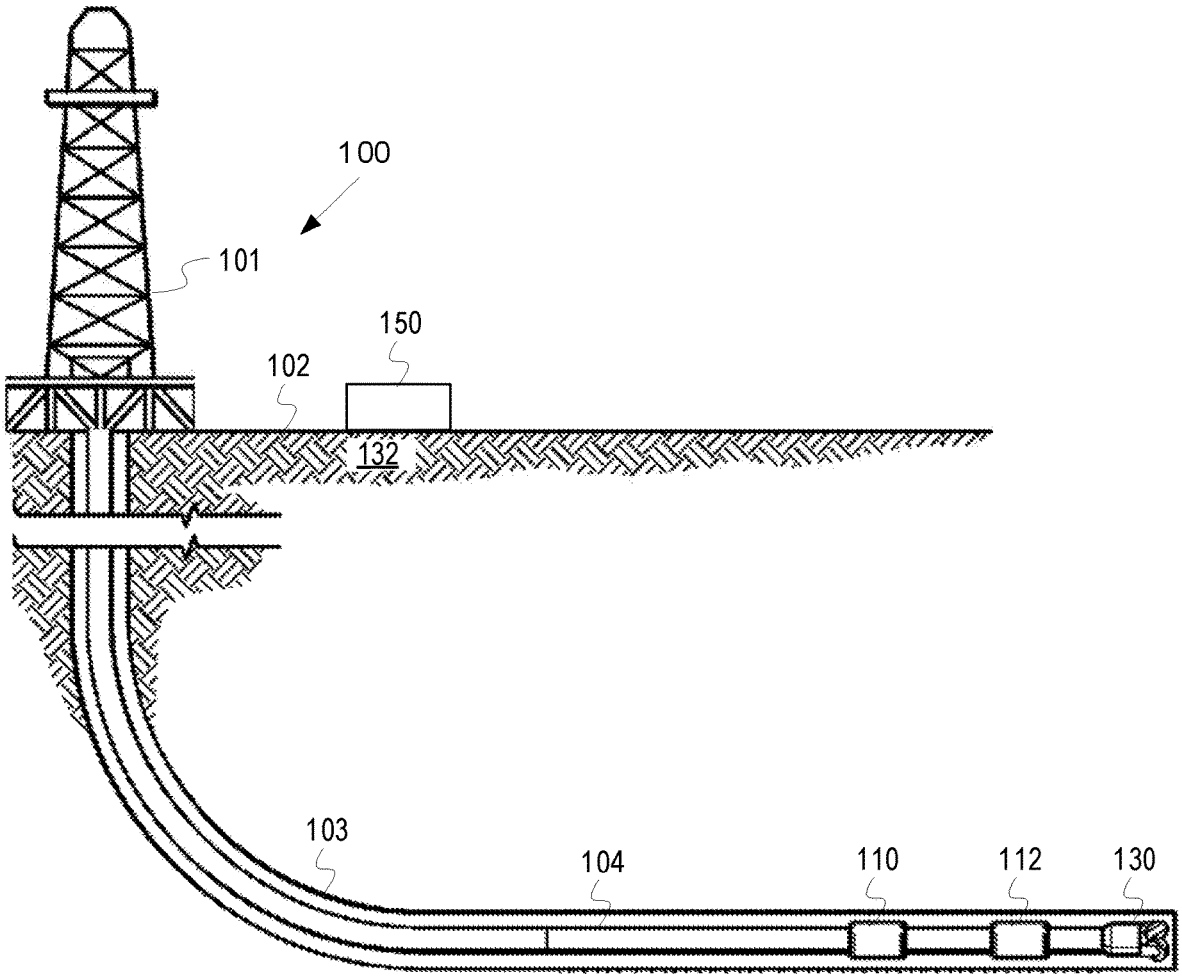
FIG. 1 depicts an example drilling system including a drill pipe with multiple agitators, according to some embodiments.

The description that follows includes example systems, methods, techniques, and program flows that embody examples of the disclosure. However, it is understood that this disclosure can be practiced without these specific details. For instance, this disclosure refers to determining an effective distance for a spring-based agitator in illustrative examples. Examples of this disclosure can be also applied to other types of agitators such as magnet-based agitators or electronic agitators. Other instances, well-known instruction instances, protocols, structures and techniques have not been shown in detail in order not to obfuscate the description.

Various embodiments disclosed herein relate to configuring and operating a drill string with a bottom hole assembly (BHA) having multiple agitators. As further described below, operation of the multiple agitators during drilling can reduce friction between different parts of the drill string and the surrounding walls of the borehole. For example, multiple agitators can be operative when the multiple agitators are located at a non-vertical portion of the borehole (e.g., horizontal or slanted portions). Additionally, the different parts of the drill string whose friction with the surrounding borehole walls is being reduced can include those sections of drill pipe along the BHA that are connecting various tools, drill bits, components, etc. of the BHA. For example, these sections of drill string can include a section of drill pipe connected to the drill bit, a section of drill pipe connecting a first agitator and a second agitator, a section of drill pipe connecting tool A to tool B, etc. Some embodiments determine an effective distance of each agitator along the drill string. An effective distance of an agitator can be the distance along the drill string that is in a kinetic friction regime as a result of stress waves generated by the agitator. In some embodiments, a length of drill string is in the kinetic friction regime when that length of pipe is moving. The length of drill string can move in response to the stress waves generated by the agitator. Long lengths of drill string can include multiple agitators to increase the total length of drill string kept in a kinetic friction regime. However, an undesired consequence can be that these agitators can create stress wave interference, wherein the stress waves from different agitators can interfere with each other. Stress wave interference can reduce the length of drill string in the kinetic friction regime. One method of minimizing stress wave interference can be to ensure that agitators remain spatially separated. However, too much separation can result in non-moving lengths of pipe.

In some embodiments, positions of the agitators during a drilling operation can be based on determining an effective distance. By determining the effective distance, agitators can be positioned such that stress wave interference can be reduced while increasing the total length of the drill pipe kept in a kinetic friction regime. For example, drill pipe parameters, fluid parameters, and operational parameters can be known or determined during well planning. An effective distance of an agitator can be determined based on these drill pipe parameters, fluid parameters, and operational parameters. Once an effective distance is determined for one or more agitators, the agitators can be positioned to maximize the total length of drill pipe in the kinetic friction regime and minimize stress wave interference. For example, in some embodiments, a distance between a first agitator and a second agitator along the BHA can be twice the effective distance. Accordingly, various embodiments can provide optimal agitator placement when configuring a BHA.

In some embodiments, operational parameters (e.g., amplitude of acceleration, frequency, etc.) of the agitators during a drilling operation can also be determined based on the effective distance. For example, an agitator can be positioned on the BHA and lowered into a well without previously determining an effective distance of the agitator. If the position of the agitator is known with respect to other agitators or tools, then a preset effective distance can be determined. Changing the operational parameters can change the effective distance of an agitator to satisfy this preset effective distance.

Example Systems

FIG. 1 depicts an example drilling system including a drill pipe with multiple agitators, according to some embodiments. FIG. 1 depicts a drilling system 100. The drilling system 100 includes a drilling rig 101 located at the surface 102 of a borehole 103. The drilling system 100 also includes a pump 150 that can be operated to pump fluid through a drill string 104. The drill string 104 can be operated for drilling the borehole 103 through the subsurface formation 132 with the BHA.

The BHA includes a drill bit 130 at the downhole end of the drill string 104 and the agitators 110 and 112. The drill bit 130 can be operated to create the borehole 103 by penetrating the surface 102 and subsurface formation 132. In some embodiments, the agitators 110 and 112 can be activated to generate stress waves on the drill string 104. For example, drilling fluid being pumped from the drilling rig 101 can provide the energy to the agitators 110 and 112 to generate stress waves on the drill string 104. As further described below, the stress waves generated by the agitators 110 and 112 can bring a length of the drill string 104 into the kinetic friction regime. By increasing or decreasing the fluid flow rate, or altering the fluid parameters, amplitudes and/or frequencies of the stress waves generated by the agitators can also change.

Figure 2:
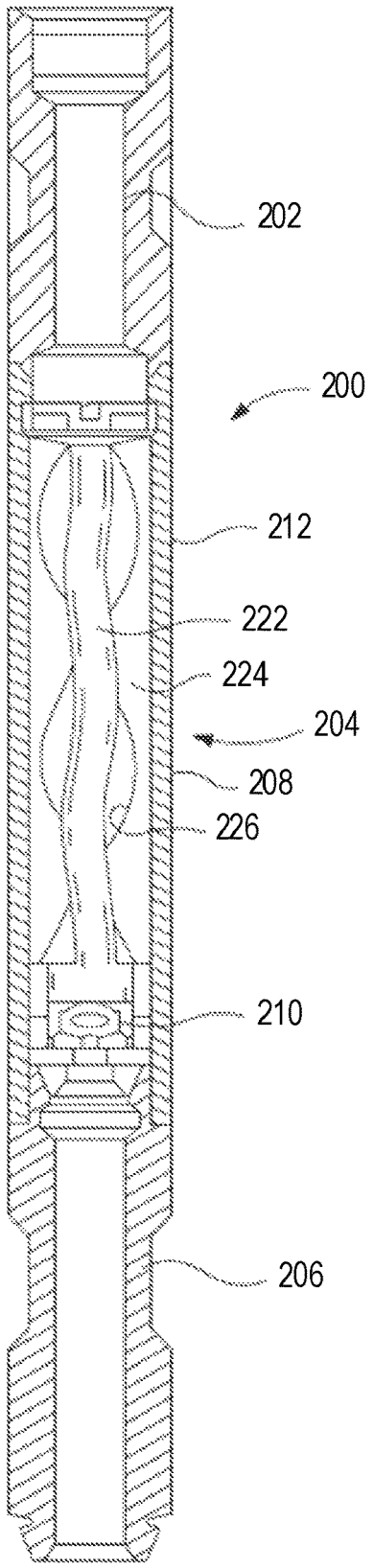
FIG. 2 depicts an example agitator, according to some embodiments.

FIG. 2 depicts an example agitator, according to some embodiments. An agitator 200 can also be referred to as a pulse generator device or an axial oscillation tool. The agitator 200 can be of the hydraulic type that is operated by controlling the flow of fluid (e.g., drilling fluid) therethrough. In some embodiments, other types of agitators that are battery operated or pneumatically operated can also be used.

As illustrated, the agitator 200 can include an upper sub 202, an agitator assembly 204, and a lower sub 206. The agitator assembly 204 includes a power section 208 that is operatively coupled to a valve assembly 210 and disposed within an outer body 212 of the agitator 200. The power section 208 can include a rotor 222 and a stator 224 forming a progressive cavity motor where a fluid flow through an annulus 226 defined between the rotor 222 and the stator 224 causes the rotor 222 to rotate. It is understood that in other embodiments, other motors, torque generators, actuators, and other devices can be used in place of the power section 208.

The valve assembly 210 can be operatively coupled to the rotor 222 of the power section 208. The valve assembly 210 can be an axial flow valve, a radial flow valve, or any other valve configuration that can be operated by the power section 208. The valve assembly 210 can be selectively opened and shut to allow fluid to flow between the agitator assembly 204 and the lower sub 206. By selectively allowing fluid flow through valve assembly 210, pressure fluctuations or pressure pulses in the fluid pressure are generated in the agitator 200, which creates vibrations in the agitator 200. The frequency of the pressure pulses (and the resulting vibrations) generated by the agitator 200 can be dependent on the time interval between the shutting and opening of the valve assembly 210. The vibrations create movement in a drill pipe operatively coupled to the agitator 200 and thereby reduce the friction experienced by the drill pipe, which causes the drill pipe to be conveyed through a wellbore more easily. It should be noted that this description can refer to the "frequency of the stress waves or vibrations generated by the agitator" as the "frequency of the agitator." Both instances refer to the same thing and therefore can be used interchangeably throughout this description. Likewise, it should be noted that the description can refer to the "amplitude of acceleration for the stress waves or vibrations generated by the agitator" as the "acceleration amplitude of the agitator" or as the "amplitude of acceleration of the agitator." Again, these instances refer to the same thing and therefore can be used interchangeably throughout this description.

Figure 3:
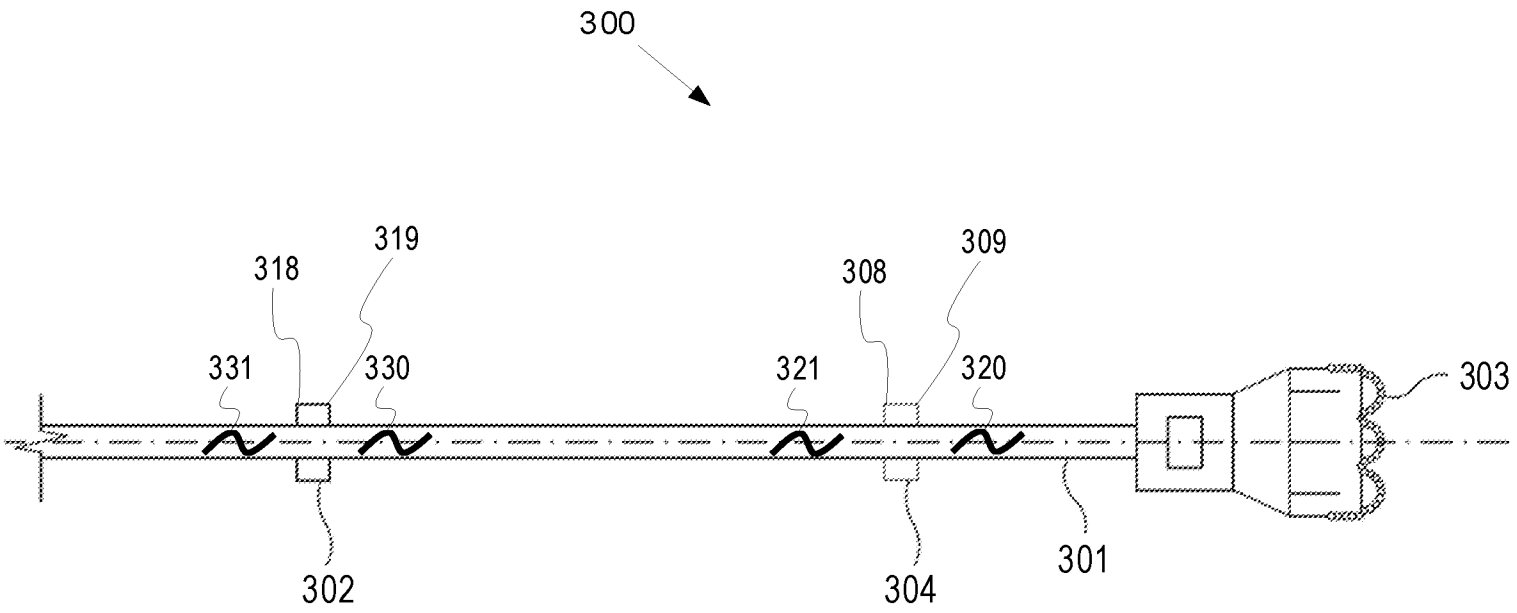
FIG. 3 depicts stress waves from an agitator propagating through a drill pipe with multiple agitators, according to some embodiments.

FIG. 3 depicts stress waves from an agitator propagating through a drill pipe with multiple agitators, according to some embodiments. FIG. 3 depicts a bottom hole assembly 300 including a drill pipe 301. A drill bit 303 is at the right (downhole) end of the drill pipe 301. An agitator 304 is attached to the drill pipe 301 at pipe-agitator boundaries 308 and 309, and is to the left (uphole) of the drill bit 303. An agitator 302 is attached to the drill pipe 301 at the pipe-agitator boundaries 318 and 319, and is uphole of the agitator 304. The agitator 304 can generate stress waves 320 and 321. The stress wave 320 can propagate through the drill pipe 301 towards the drill bit 303. The stress wave 321 can propagate through the drill pipe 301 towards the agitator 302. The agitator 302 can generate stress waves 330 and 331. The stress wave 330 can propagate through the drill pipe 301 towards the agitator 304. The stress wave 331 can propagate through the drill pipe 301 towards the surface and away from the drill bit 303.

In some embodiments, each agitator can generate stress waves in a periodic cycle. For example, the frequency of the stress waves can be 5-30 Hz. In some embodiments, the acceleration of the agitator is also a periodic cycle and can be modeled in Equation 1, where $a_a$ is an acceleration value, $a_0$ is the acceleration amplitude of the agitator, ω is the frequency of the agitator, and t is time:

$$a_a = a_0 \sin \omega t \tag{1}$$

In the case where velocity and acceleration are both zero when time is zero, the above expression can be derived and transformed into Equation 2, where each variable is defined as above, and $v_0$ is the velocity at a pipe-agitator boundary:

$$v_0 = -\frac{a_0}{\omega}\cos\omega t \tag{2}$$

Equation 2 can be augmented to consider the vibration velocity at a point x along the drill pipe. For example, if the stress wave 320 is x meters away from the pipe-agitator boundary 309, the vibration velocity at the position of the stress wave 320 can be determined by Equation 3, where each variable defined above, $C_0$ is the speed of sound in a drill pipe and $v_{0x}$ is the vibration velocity at position x:

$$v_{0x} = -\frac{a_0}{\omega}\cos\omega\left(t - \frac{x}{C_0}\right) \tag{3}$$

Equation 3 can be augmented to consider the effects of friction force on the drill pipe by including properties such as a kinetic friction coefficient. A kinetic friction coefficient of an object can be defined as the ratio of a friction force applied onto the object by a surface relative to a normal force applied onto the object by the surface while the object is sliding along the surface. For example, with reference to FIG. 1, in the case of the section of pipe between agitators 110 and 112, the section of pipe can be pulled down by a gravity force such that it is in contact with the formation sidewall of the borehole 103. In response to this gravity force, the formation sidewall of the borehole 103 will apply a normal force onto the section of pipe that prevents the pipe from penetrating through the formation sidewall of the borehole 103. The agitators 110 and 112 can apply a force onto the pipe that is parallel to the axis of the pipe, causing the pipe to slide along the formation sidewall of the borehole 103. In response to this sliding, a friction force can be applied onto the section of pipe by the formation sidewall of the borehole 103. the kinetic friction coefficient can be the ratio of the friction force applied onto the section of pipe by the formation sidewall of the borehole 103 relative to the normal force applied onto the pipe by the formation sidewall of the borehole 103 while the pipe is in motion. In some embodiments, this kinetic friction coefficient can be a property of the section of pipe.

In some embodiments, augmenting Equation 3 can result in Equation 4 where $a_0$ is the acceleration amplitude of the agitator, $\omega$ is the frequency of the agitator, t is time, $v_0$ is the velocity at a pipe-agitator boundary, $C_0$ is the speed of sound in a drill pipe, $v_{0x}$ is the vibration velocity at position x, g is the gravitational constant, $\rho_0$ is a drill pipe density, $\rho_f$ is a fluid density, and $\mu_k$ is a kinetic friction coefficient:

$$v_x = -\frac{a_0}{\omega}\cos\omega\left(t - \frac{x}{C_0}\right) - \frac{g\mu_k(\rho_o - \rho_f)}{\rho_o C_0}x \tag{4}$$

In some embodiments, stress waves from different agitators can interfere when they encounter each other along the drill pipe. For example, the stress wave 321 can interfere with the stress wave 330. Such interference can be destructive and the stress wave 321 can cancel the stress wave 330. Alternatively, this interference can be constructive, and the stress wave 321 can sum with the stress wave 330 to generate a more powerful stress effect at the point of interference. Setting a distance between each agitator based on the effective distances for the agitators 302 and 304 can reduce the effects of stress wave interference on the drill pipe 301.

Figure 4:
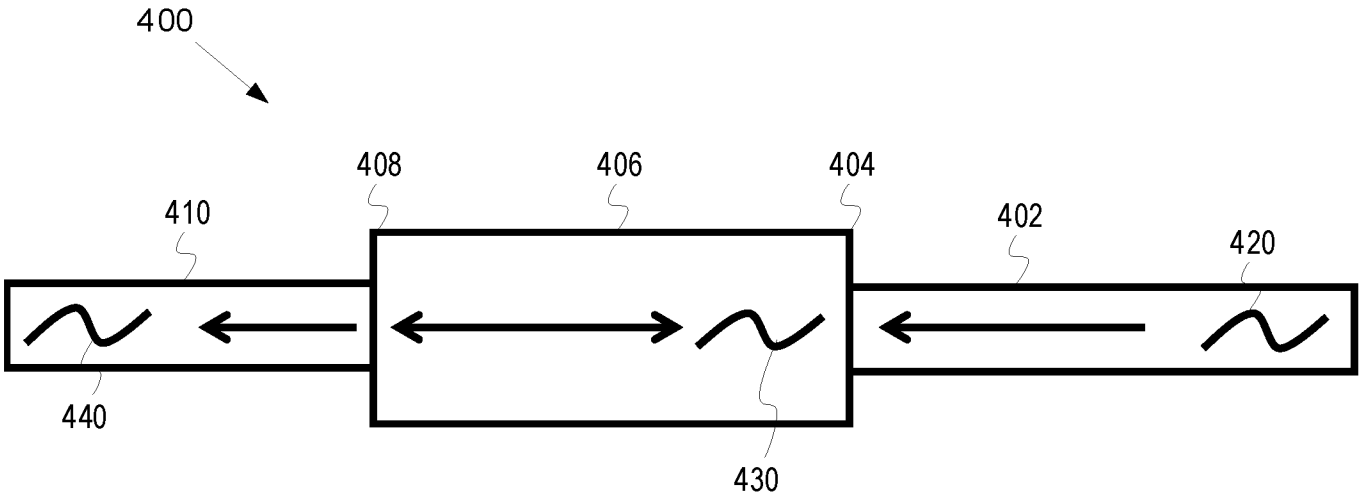
FIG. 4 depicts stress waves from an agitator propagating through drill pipes with two diameters, according to some embodiments.

FIG. 4 depicts stress waves from an agitator propagating through drill pipes with two diameters, according to some embodiments. FIG. 4 depicts drill pipes 400 that includes a drill pipe 402, a drill pipe 406, and a drill pipe 410. The drill pipe 402 is connected to the right side of the drill pipe 406. The drill pipe 406 is connected to the right side of the drill pipe 410. In this example, a diameter of the drill pipe 406 is different from the diameters of each of the drill pipes 402 and 410. The stress wave 420 can propagate through the drill pipe 402 towards the drill pipe 406. A pipe-pipe boundary 404 is the boundary between the drill pipe 406 and the drill pipe 402. The stress wave 420 can be converted to a stress wave 430 after penetrating the pipe-pipe boundary 404. The stress wave 430 can propagate through the drill pipe 406 towards the drill pipe 410. A portion of the stress wave 430 can be reflected back towards the drill pipe 402 upon reaching the pipe-pipe boundary 408. Additionally, a portion of the stress wave 430 can penetrate through the pipe-pipe boundary 408 towards the drill pipe 410.

In some embodiments, a drill pipe system can include tools or drill pipes of different diameters between agitators. Stress waves that encounter a boundary can penetrate through the boundary or be reflected at the boundary. A boundary can include a boundary wherein drill pipe radius changes, a tool attaches to the drill pipe, or a different material is used. In the case of one or more changes in drill pipe radius, the vibration velocity can be dependent on a radius ratio. The radius ratio is a ratio between the radius of a source drill pipe that a stress wave is propagating through and the radius of a middle drill pipe that the stress wave can propagating towards. For example, for stress wave 420, the source drill pipe is the drill pipe 402 and the middle drill pipe is the drill pipe 406. A model for vibration speed changes can be represented by Equation 5, where n is a radius ratio, $L_p$ is the length of the middle drill pipe, i is the index of the penetrating stress wave after i-th reflection, g is the gravitational constant, $\rho_0$ is a drill pipe density, $\rho_f$ is a fluid density, $C_0$ is the speed of sound in a drill pipe, $\mu_k$ is a kinetic friction coefficient, $a_0$ is the acceleration amplitude of the agitator, and $\omega$ is the frequency of the agitator, as previously described:

$$v_x = -\frac{a_0}{\omega}\sum_{i=0}^{i=m}\frac{(1-n)^{2i}}{(1+n)^{2i}}\frac{4n}{(1+n)^2}\cos\omega\left(t - \frac{x}{C_0} - \frac{2iL_{p2}}{C_0}\right) + \frac{g\mu_k(\rho_o - \rho_f)}{\rho_o C_0}x \tag{5}$$

In some embodiments, the length of the middle string can also change the vibration velocity. As can be observed above in Equation 5, changing the value of length of the middle drill pipe $L_p$ can shift the phase of the vibration velocity. In some embodiments, a tool with a specified length can be attached to the drill pipe to directly shift the phase of the stress waves.

Example Data

Figure 5:
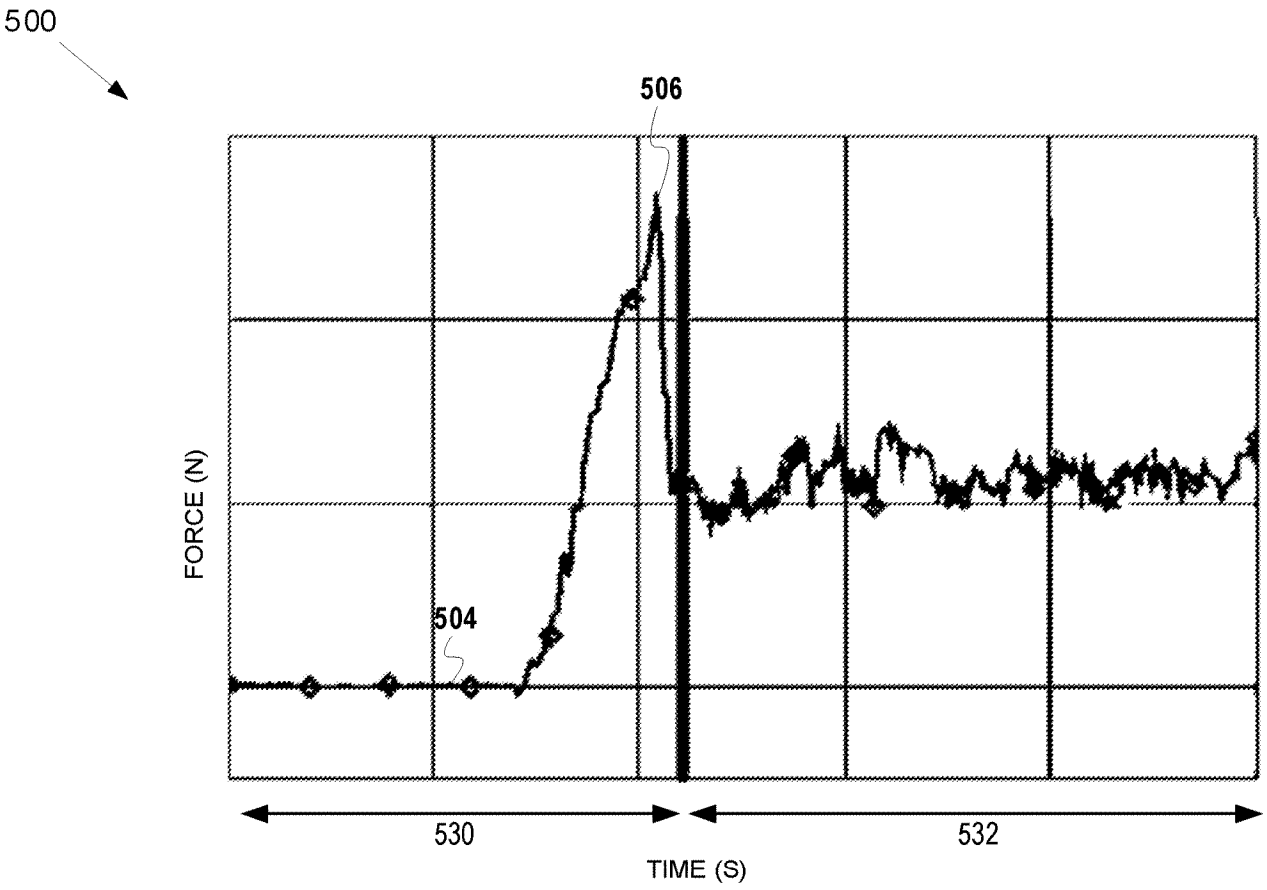
FIG. 5 depicts a plot demonstrating the difference between a static friction force and a kinetic friction force, according to some embodiments.

FIG. 5 depicts a plot demonstrating the difference between a static friction force and a kinetic friction force, according to some embodiments. A static friction force can be defined to include any force on an object resulting from friction between a surface and an object when the object is stationary with respect to the surface. A kinetic friction force can be defined to includes any force on an object resulting from friction between a surface and an object when the object is in motion with respect to the surface. FIG. 5 depicts a plot 500 and includes a plotline 504. The plotline 504 represents a force applied onto an initially stationary object. For an initial time period 530, the object is stationary as force is applied onto the object. The stationary object experiences a static friction force in response to the applied force. However, at the peak point 506, the object's static friction force can no longer match the applied force and the object begins to move. This motion puts the object into the kinetic friction regime for a time period 532. In the kinetic friction regime, the force applied to keep the object in motion can be less than the static friction force that was overcome at the peak point 506 to start the object motion.

Figure 6:
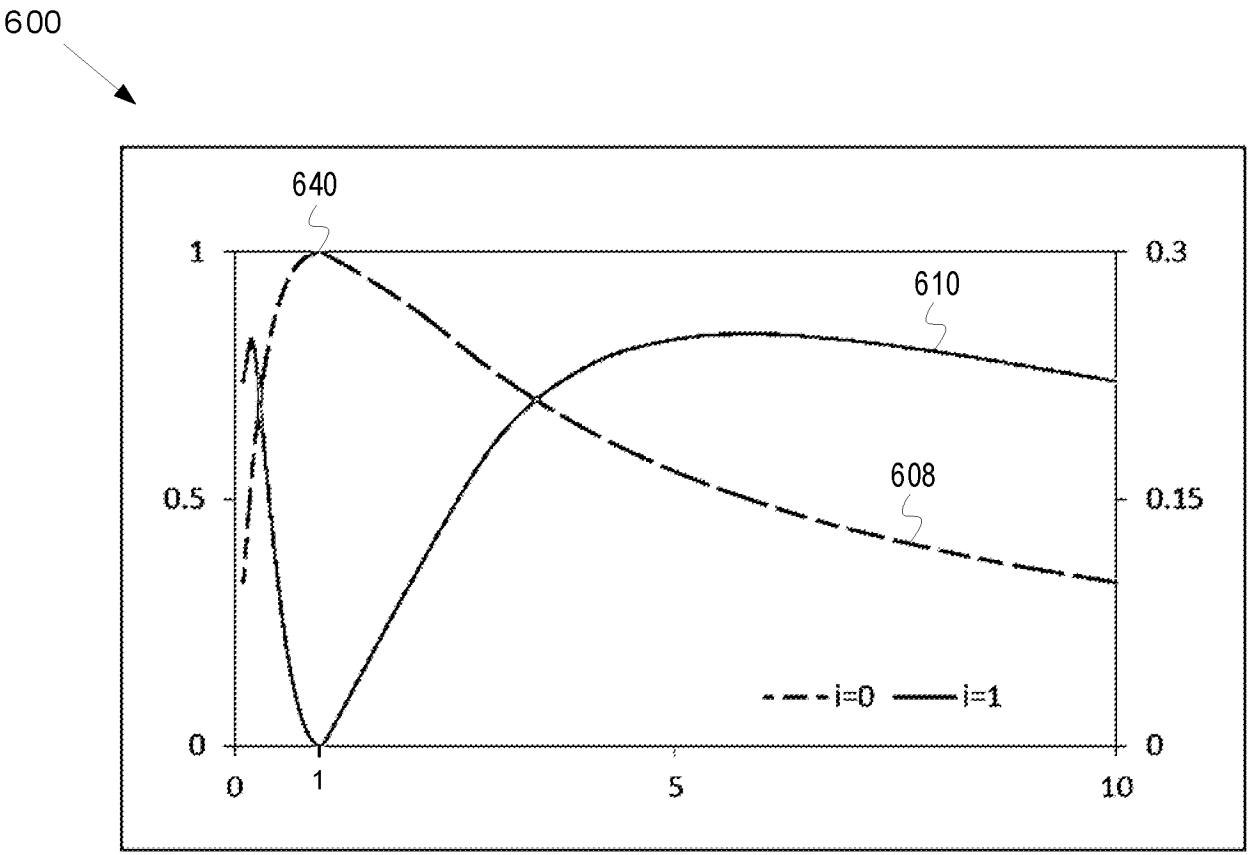
FIG. 6 depicts a plot showing the first and second penetration ratios of a stress wave as a function of the ratio of drill pipe radius, according to some embodiments.
Figure 8:
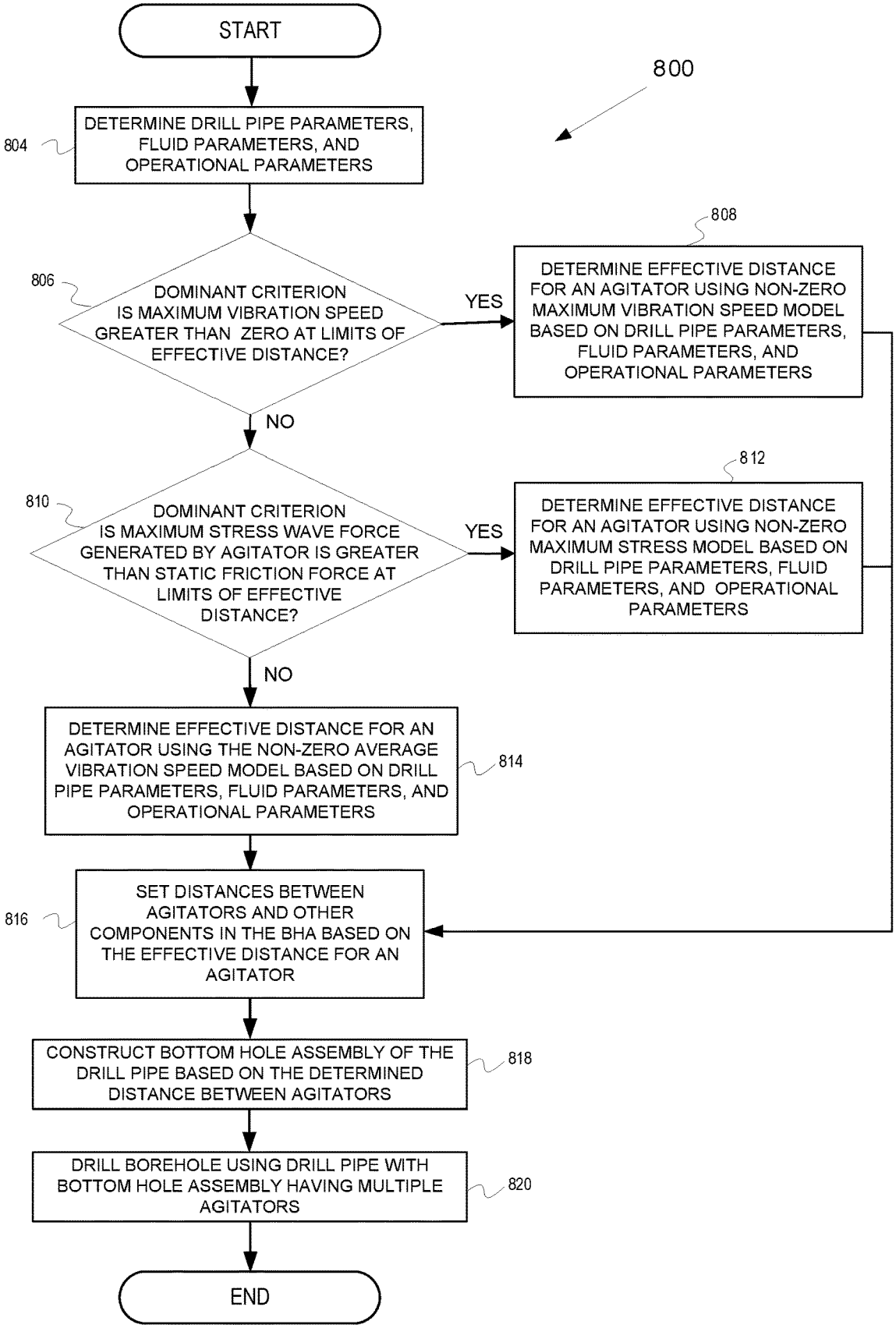
FIG. 8 depicts a flowchart of operations for determining an effective distance for positioning between multiple agitators of a bottom hole assembly of a drill string, according to some embodiments.
Figure 9:
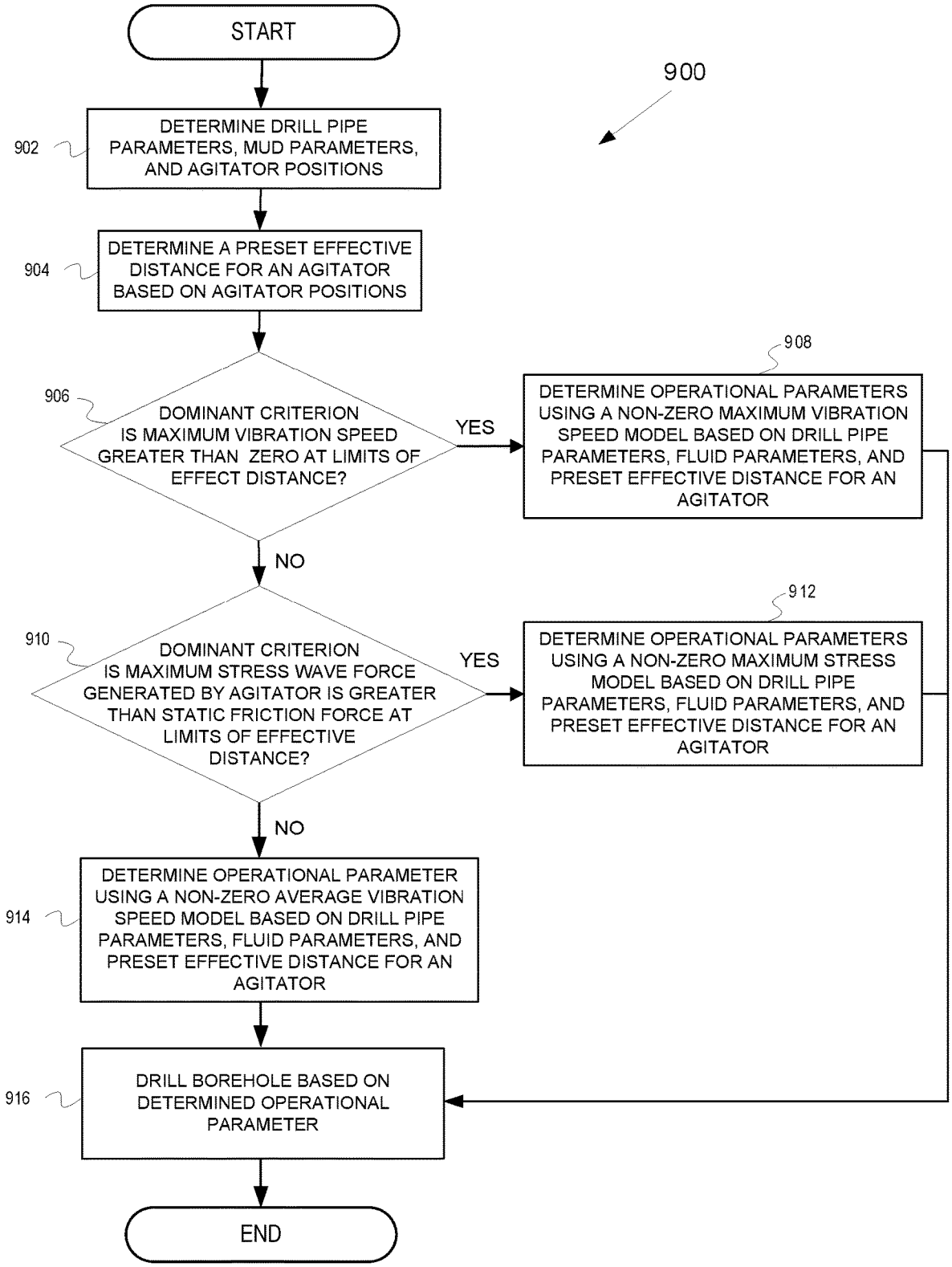
FIG. 9 depicts a flowchart of operations for drilling a borehole using a drill pipe with a bottom hole assembly having multiple agitators, according to some embodiments.

FIG. 6 depicts a plot showing the first and second penetration ratios of a stress wave as a function of the ratio of drill pipe radius, according to some embodiments. With reference to FIG. 4, the plot 600 depicts the relationship between a radius ratio and penetration ratios. The radius ratio is the ratio of the radius of the drill pipe 406 to the radius of the drill pipe 402. A first penetration ratio is the penetration vibration speed in the drill pipe 410 over the original penetration vibration speed in the drill pipe 402 without any reflection at the pipe-pipe boundaries 404 and 408. A second penetration ratio is the penetration vibration speed in the drill pipe 410 after being reflected once at the pipe-pipe boundaries 404 and 408. The x-axis of the plot 600 represents the radius ratio. The y-axis of the plot 600 represents the penetration ratios. The plot 600 includes a first penetration ratio plotline 608 and a second penetration ratio plotline 610. For example, at a radius ratio of 1, the fraction of a stress wave that has penetrated through the pipe-pipe boundary 404 is 1, and thus is shown to fully penetrate the pipe-pipe boundary 404. As demonstrated by the plot 600, a stress wave penetration ratio can be lower than 1.0 when drill pipe radii changes. With reference to FIGS. 8 and 9 (further described below), this can denote that a non-zero average vibration speed model should be used, instead of a non-zero maximum vibration speed greater than zero model or a non-zero maximum stress model.

Figure 7:
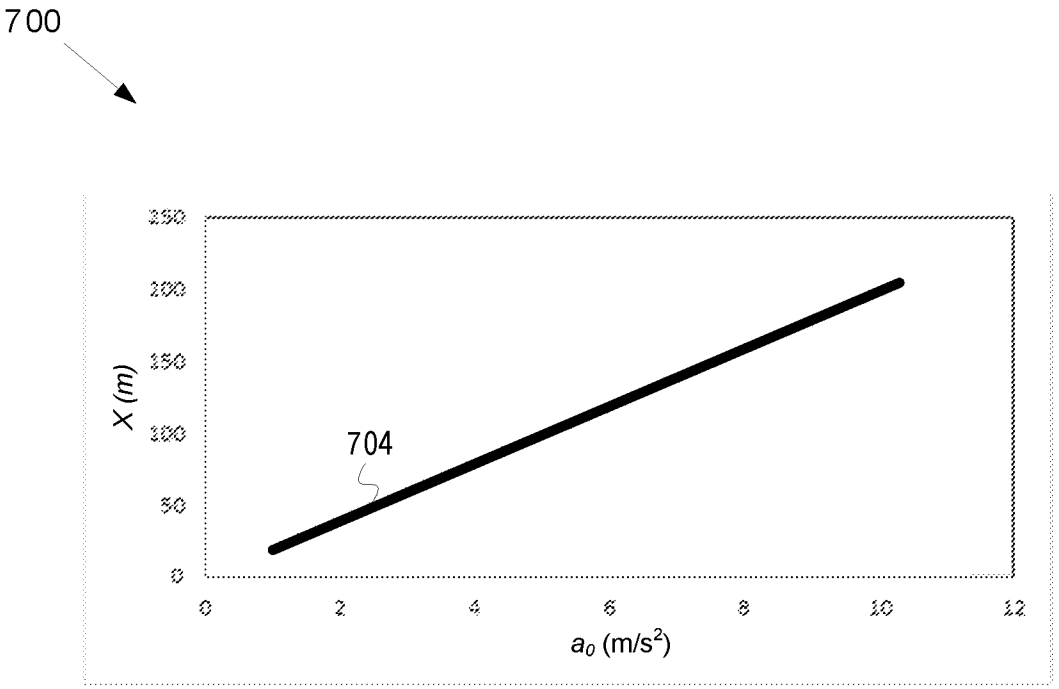
FIG. 7 depicts a plot showing the relationship between the amplitude of acceleration and the effective distance for an agitator, according to some embodiments.

FIG. 7 depicts a plot showing the relationship between the amplitude of acceleration and the effective distance for an agitator, according to some embodiments. FIG. 7 depicts the plot 700 and includes the plotline 704. The x-axis of the plot 700 is an amplitude of acceleration for an agitator and the y-axis is an effective distance for the agitator in meters. In some embodiments, the plotline 704 can be linear and represents a linear relationship between the amplitude of acceleration for the agitator and the effective distance for the agitator.

Example Operations

Example operations are now described for determining and using an effective distance of an agitator for positioning and/or operational parameters of agitators during drilling operations.

FIG. 8 depicts a flowchart of operations for determining an effective distance for positioning between multiple agitators of a bottom hole assembly of a drill string, according to some embodiments. Operations of a flowchart 800 of FIG. 8 can be performed by software, firmware, hardware or a combination thereof. For example, with reference to FIG. 10 (further described below), a processor in a computer device can execute instructions to perform operations of the flowchart 800. The example operations are described with reference to FIGS. 1, 3, and 10.

At block 804, drill pipe parameters, fluid parameters, and operational parameters are determined. The drill pipe parameters can be related to properties of the drill pipe. For example, the drill pipe parameters can include the drill pipe density po, speed of sound in the drill pipe Ca, kinetic friction coefficient μk, etc. In some embodiments, drill pipe parameters can be separated into drill pipe parameters for different drill pipe sections. For example, a pipe density of a drill pipe section connecting two agitators can be determined separately from the drill pipe section connecting an agitator and a drill bit. The fluid parameters can be related to properties of the fluid. For example, the fluid parameters can include the fluid density Ph composition of the fluid, etc. The operational parameters can be related to any controllable parameters during drilling. For example, the operational parameters can include the agitator parameters such as the acceleration amplitude of the agitator $a_0$, frequency of the agitator ω, etc. The operational parameters can also include parameters than can influence agitator parameters, such as fluid flow rate. The operational parameters can also include parameters that can influence the fluid parameters, such as fluid density $\rho_f$. The drill pipe parameters and fluid parameters can be determined through testing, accessing a data table, user input, etc.

The model for an effective distance can be based on the above-mentioned parameters, with specific forms of the model dependent on a dominant criterion, wherein a dominant criterion can be defined as the criterion that controls what particular effective distance model will be used in the operations. The dominant criterion can be that the maximum vibration speed is greater than zero at the limits of the effective distance. Alternatively, the dominant criterion can be that the maximum stress wave force generated by an agitator is greater than the static friction force at the limits of the effective distance.

At block 806, a determination is made of whether the dominant criterion is that the maximum vibration speed is greater than zero at the limits of the effective distance. This determination can be based on if the most significant concern is that a section of drill pipe can move at least once during the periodic motion of the agitator. For example, if the most significant concern is that a section of drill pipe can move at least once during the periodic motion of the agitator, then it can be determined that the dominant criterion is that the maximum vibration speed is greater than zero at the limits of the effective distance. If the dominant criterion is that the maximum vibration speed is greater than zero at the limits of the effective distance, operations of the flowchart 800 continue at block 808. Otherwise, if the dominant criterion is not that the maximum vibration is greater than zero, operations of the flowchart 800 continue at block 810.

At block 808, the effective distance for an agitator is determined using a non-zero maximum vibration speed model based on the drill pipe parameters, fluid parameters, and operational parameters. The non-zero maximum vibration speed model can be represented by Equation 6, where $x_{eff}$ is the effective distance, E is an experience parameter, g is the gravitational constant, $\rho_0$ is a drill pipe density, $\rho_f$ is a fluid density, $C_0$ is the speed of sound in a drill pipe, $\mu_k$ is a kinetic friction coefficient, $a_0$ is the acceleration amplitude of the agitator, and ω is the frequency of the agitator, as previously described:

$$x_{eff} = E\frac{\rho_o C_0 a_0}{\omega g \mu_k(\rho_o - \rho_f)} \tag{6}$$

For example, using Equation 6, if the experience parameter is 1.0, drill pipe density po is 8000 kg/m$^3$, the speed of sound in the drill pipe $C_0$ is 6000 m/s, the acceleration amplitude of the agitator $a_0$ is 1 m/s$^2$, the frequency of the agitator ω is 20 s$^{-1}$, the gravitational constant g is 9.8 N/m, the kinetic friction coefficient $\mu_k$ is 0.4, and the fluid density $\rho_f$ is 2000 kg/m$^3$, then the effective distance $x_{eff}$ can be determined to be 102 meters.

In some embodiments, additional distance-reducing factors can be included in an effective distance model. For example, distance-reducing factors can include fluid drag force and/or heat loss in the stress wave. The experience parameter can be used as shown in Equation 6 to account for these distance-reducing factors. In a model that accounts for phenomena such as heat loss and fluid drag force, the experience parameter can be less than one.

At block 810, a determination is made of whether the dominant criterion is that the maximum stress wave force generated by an agitator is greater than the static friction force at the limits of the effective distance. This determination can be based on if the most significant concern is that a force applied onto the drill pipe is sufficiently great to overcome static friction at least once during the periodic motion of the agitator. For example, if the most significant concern is that a force applied onto the drill pipe is sufficiently great to overcome static friction at least once during the periodic motion of the agitator, then it can be determined that the dominant criterion is that the maximum applied force is greater than the static friction force at the limits of the effective distance. If the dominant criterion is that the maximum stress wave force generated by an agitator is greater than the static friction force at the limits of the effective distance, then the operation of flowchart 800 continues at block 812. Otherwise, if the dominant criterion is not that the maximum stress wave force generated by an agitator is greater than the static friction force at the limits of the effective distance, the operation of flowchart 800 continues at block 814.

At block 812, the effective distance for an agitator is determined using a non-zero maximum stress model based on the drill pipe parameters, fluid parameters, and operational parameters. Under the non-zero maximum stress model, the ratio of the kinetic friction and static friction is subtracted. In this context, the static friction coefficient is a friction coefficient for a stationary object. For example, for a section of pipe that is in contact with a borehole wall, the static friction coefficient can be the ratio of a friction force applied onto a pipe from the borehole wall relative to the normal force applied onto the pipe from the borehole wall, while the pipe is stationary. The non-zero maximum vibration speed model can be represented by Equation 7, where $x_{eff}$ is the effective distance, E is an experience parameter, g is the gravitational constant, $\rho_0$ is a drill pipe density, $\rho_f$ is a fluid density, $C_0$ is the speed of sound in a drill pipe, $\mu_k$ is a kinetic friction coefficient, $\mu_s$ is the static friction coefficient, $a_0$ is the acceleration amplitude of the agitator, and $\omega$ is the frequency of the agitator, as previously described:

$$x_{eff} = E\left(\frac{\rho_o C_0 a_0}{\omega g \mu_k (\rho_o - \rho_f)} - \frac{\mu_s}{\mu_k}\right) \tag{7}$$

For example, using Equation 7, if the experience parameter is 1.0, drill pipe density $\rho_0$ is 8000 kg/m$^3$, the speed of sound in the drill pipe $C_0$ is 6000 m/s, the acceleration amplitude of the agitator $a_0$ is 1 m/s$^2$, the frequency of the agitator $\omega$ is 20 s$^{4}$, the gravitational constant g is 9.8 N/m, the kinetic friction coefficient $\mu_k$ is 0.4, the static friction coefficient $\mu_s$ is 0.8, and the fluid density $\rho_f$ is 2000 kg/m$^3$, then $x_{eff}$ can be determined to be 100 meters.

At block 814, the effective distance for an agitator is determined using a non-zero average vibration speed model based on the drill pipe parameters, fluid parameters, and operational parameters. Under the non-zero average vibration speed model, a compensating coefficient such as $2/\pi$ can be included in the effective distance determination. For example, the non-zero average vibration speed model can be represented by Equation 8, where $x_{eff}$ is the effective distance, g is the gravitational constant, $\rho_0$ is a drill pipe density, $\rho_f$ is a fluid density, $C_0$ is the speed of sound in a drill pipe, E is an experience parameter, $\mu_k$ is a kinetic friction coefficient, $a_0$ is the acceleration amplitude of the agitator, and $\omega$ is the frequency of the agitator, as previously described:

$$x_{eff} = E\frac{2\rho_o C_0 a_0}{\pi \omega g \mu_k (\rho_o - \rho_f)} \tag{8}$$

For example, using Equation 8, if the experiencer parameter is 1.0, drill pipe density $\rho_0$ is 8000 kg/m$^3$, the speed of sound in the drill pipe $C_0$ is 6000 m/s, the acceleration amplitude of the agitator $a_0$ is 1 m/s$^2$, the frequency of the agitator $\omega$ is 20 s$^{-1}$, the gravitational constant g is 9.8 N/m, the kinetic friction coefficient $\mu_k$ is 0.4, and the fluid density $\rho_f$ is 2000 kg/m$^3$, then the effective distance $x_{eff}$ can be determined to be 65 meters.

At block 816, the distance between the agitator and other components in the BHA are set based on the effective distance. For example, the other components can include a different agitator, the drill bit, a stabilizer, a drill collar, a mud motor, etc. Under the effective distance model, any length of the drill pipe within an effective distance from a pipe-agitator boundary can be in the kinetic friction regime. In some embodiments, the total length of drill pipe covered by at least one effective distance from the pipe-agitator boundary can be increased while maintaining a continuous length of drill pipe in the kinetic friction regime. To increase the total length of drill pipe covered by at least one effective distance, the distance between agitators can be set equal to be the sum of their respective effective distances. The distance between an agitator and a non-agitator tool can be set to be equal to the effective distance. For example, with respect to FIG. 3, the effective distance for each of the agitators 302 and 304 can be determined to be 100 m. The sum of the effective distances of each of the agitators 302 and 304 is 200 m. The distance between agitators 302 and 304 can be set to be equal to 200 m.

In some embodiments, setting the distance between the agitator and other components in the BHA can include generating a model of a bottom hole assembly. The model of the bottom hole assembly can be a visual representation of the bottom hole assembly to aid in the construction of the bottom hole assembly. The model of the bottom hole assembly can include a drill bit, a first agitator, a drill pipe section connecting the drill bit with the first agitator, a second agitator, and a drill pipe section connecting the first agitator with the second agitator. The drill pipe section connecting the drill bit to the first agitator can be 65%-135% of the determined effective distance of the first agitator. The drill pipe section connecting the first agitator and the second agitator can be less than the sum of the effective distance of the first agitator and the effective distance of the second agitator. In some embodiments, the model of the bottom hole assembly can include a graphical/visual model.

At block 818, the bottom hole assembly of the drill pipe is constructed based on the determined distance between agitators. The drill pipe can be constructed at the surface and lowered into the well, and can include agitators that are positioned apart from each other, a drill bit, or other tools based on the determined distance. For example, if the determined distance between a drill bit and a first agitator is 100 m, construction of the BHA can include positioning the agitator 100 m away from the drill bit. If the determined distance between the first agitator and the second agitator is 200 m, then and the second agitator can be positioned to be 200 meters away from the first agitator. The physical assembly of the drill pipe can be performed manually or with a mechanized drilling apparatus, such as a top drive.

At block 820, a borehole is drilled using the drill pipe with a bottom hole assembly having multiple agitators. Multiple agitators can be attached to a drill pipe section while drilling a borehole. In some embodiments, the drill pipe section is non-vertical while drilling the borehole. For example, the drill pipe section with multiple agitators can either be slanted or horizontal while drilling the borehole. In some embodiments, the agitators can be activated with the operational parameters determined in block 804. Operations of the flowchart 800 are complete.

FIG. 9 depicts a flowchart of operations for drilling a borehole using a drill pipe with a bottom hole assembly having multiple agitators, according to some embodiments. Operations of a flowchart 900 of FIG. 9 can be performed by software, firmware, hardware or a combination thereof. For example, with reference to FIG. 10, a processor in a computer device can execute instructions to perform operations of the flowchart 900. With reference to FIG. 8, operations of the flowchart 900 can be performed after performing operations of flowchart 800 during drilling. Operations of the flowchart 900 can also be performed without performing operations of flowchart 800 during drilling. For example, if agitators are lowered into a well without having been positioned based on the determined distance of block 816, then the operations of flowchart 900 can still be applied. The example operations are described with reference to FIGS. 1, 3, 8, and 10.

At block 902, drill pipe parameters, fluid parameters, and agitator positions are determined. The drill pipe parameters can be related to properties of the drill pipe. For example, the drill pipe parameters can include the drill pipe density po, speed of sound in a drill pipe $C_0$, kinetic friction coefficient $\mu_k$, etc. The fluid parameters can be related to properties of the fluid. For example, the fluid parameters can include the fluid density $\rho_f$, composition of the fluid, etc. In addition to agitator positions, the positions of other components of the BHA can also be determined. The agitator positions and the positions of other components of the BHA can be either absolute or relative values. For example, the agitator positions provided as a first agitator that is 10 meters from the drill bit and a second agitator that is 25 meters from the drill bit. The drill pipe parameters, fluid parameters, and agitator positions can be determined through testing, accessing a data table, or directly inputting.

At block 904, a preset effective distance for an agitator is determined based on the agitator positions. In some embodiments, the preset effective distance for an agitator can be based on maximizing a total length of drill pipe covered by at least one effective distance from a pipe-agitator boundary without overlapping with another agitator effective distance or non-agitator tool position. For example, with reference to FIG. 3, the agitator 304 can be 50 meters away from the drill bit 303 and the agitator 302 can be 110 meters away from the drill bit 303. Based on the distance between the agitator 304 and the drill bit 303, a first possible effective distance can be the agitator-tool distance of 50 meters. Based on the distance between the agitator 304 and the agitator 302, a second possible effective distance can be 55 meters, which is half of the distance between the agitator 302 and the drill bit 303. Comparing the first and second possible effective distance values, the possible effective distance of 50 meters would also satisfy the requirement that no overlap would exist between a length of drill pipe covered by at least one effective distance from the pipe-agitator boundary and another tool position (e.g. the drill bit position).

At block 906, a determination is made of whether the dominant criterion is that the maximum vibration speed is greater than zero at the limits of the effective distance. With reference to FIG. 8, the determination can be based on the same considerations described above for block 806. If the dominant criterion is that the maximum vibration speed is greater than zero at the limits of the effective distance, operations of the flowchart 900 continue at block 908. Otherwise, if the dominant criterion is not that the maximum vibration speed is greater than zero at the limits of the effective distance, operations of the flowchart 900 continue at block 910.

At block 908, operational parameters can be determined using a non-zero maximum vibration speed model based on the drill pipe parameters, fluid parameters, and preset effective distance for an agitator. In some embodiments, operational parameters can be manipulated to influence various variables shown in Equation 8. The operational parameters of interest can depend on the controllable parameters during a drilling operation. In some embodiments, the operational parameters can include the fluid pump rate and fluid density. In some embodiments, increasing a fluid pump rate at the surface can increase the frequency of the agitator. For example, the non-zero maximum vibration speed model shown in Equation 6 can be re-arranged into Equation 9, where $x_{preset}$ is the effective distance, E is an experience parameter, g is the gravitational constant, $\rho_0$ is a drill pipe density, $\rho_f$ is a fluid density, $C_0$ is the speed of sound in a drill pipe, $\mu_k$ is a kinetic friction coefficient, $a_0$ is the acceleration amplitude of the agitator, and $\omega$ is the frequency of the agitator, as previously described:

$$\omega = E\frac{\rho_o C_0 a_0}{x_{preset} g \mu_k (\rho_o - \rho_f)} \tag{9}$$

For example, as shown in Equation 9, if the experiencer parameter is 1.0, drill pipe density $\rho_0$ is 8000 kg/m$^3$, the speed of sound in the drill pipe $C_0$ is 6000 m/s, the acceleration amplitude of the agitator $a_0$ is 1 m/s$^2$, the gravitational constant g is 9.8 N/m, the kinetic friction coefficient $\mu_k$ is 0.4, the fluid density $\rho_f$ is 2000 kg/m$^3$, and the preset effective distance $x_{preset}$ is 50 m, then the frequency of the agitator $\omega$ is 40.82 s$^{-1}$. In some embodiments, the fluid flow rate associated with an agitator frequency can be determined by using a data table or correlation function associated with the agitator. For example, an agitator frequency of 40.82 s$^{-1}$ can be correlated with a fluid pump rate of 10 barrels per minute using a data table.

At block 910, a determination is made of whether the dominant criterion is that the maximum stress wave force generated by an agitator is greater than the static friction force at the limits of the effective distance. With reference to FIG. 8, the determination can be based on the same considerations described above for block 810. If the dominant criterion is that the maximum stress wave force generated by an agitator is greater than the static friction force at the limits of the effective distance, operations of the flowchart 900 continue at block 912. Otherwise, if the dominant criterion is not that the maximum stress wave force generated by an agitator is greater than the static friction force at the limits of the effective distance, operations of the flowchart 900 continue at block 914.

At block 912, an operational parameter is determined using a non-zero maximum stress model based on the drill pipe parameters, fluid parameters, and the preset effective distance for an agitator. Under the non-zero average vibration speed model, a compensating coefficient such as $2/\pi$ can be included in the effective distance determination. The non-zero maximum vibration speed model shown in Equation 7 can be re-arranged into Equation 10, where $x_{preset}$ is the preset effective distance for an agitator, E is an experience parameter, g is the gravitational constant, $\rho_0$ is a drill pipe density, $\rho_f$ is a fluid density, $C_0$ is the speed of sound in a drill pipe, $\mu_k$ is a kinetic friction coefficient, $a_0$ is the acceleration amplitude of the agitator, and $\omega$ is the frequency of the agitator, as previously described:

$$\omega = E\left(\frac{\rho_o C_0 a_0}{x_{preset} g \mu_k (\rho_o - \rho_f)} - \frac{\mu_s}{x_{preset} \mu_k}\right) \tag{10}$$

For example, as shown in Equation 9, if the experiencer parameter is 1.0, drill pipe density $\rho_0$ is 8000 kg/m$^3$, the speed of sound in the drill pipe $C_0$ is 6000 m/s, the acceleration amplitude of the agitator $a_0$ is 1 m/s$^2$, the gravitational constant g is 9.8 N/m, the kinetic friction coefficient $\mu_k$ is 0.4, the static friction coefficient $\mu_s$ is 0.8, the fluid density $\rho_f$ is 2000 kg/m$^3$, and the preset effective distance $x_{preset}$ is 50 m, then the frequency of the agitator $\omega$ is 40.77 s$^{-1}$. In some embodiments, the fluid flow rate associated with an agitator frequency can be determined by using a data table or correlation function associated with the agitator. For example, an agitator frequency of 40.77 s$^{-1}$ can be correlated with a fluid pump rate of 9.6 barrels per minute.

At block 914, an operational parameter is determined using a non-zero average vibration speed model based on the drill pipe parameters, fluid parameters, and preset effective distance for an agitator. Under the non-zero average vibration speed model, the ratio of the kinetic friction and static friction is subtracted. The non-zero maximum vibration speed model shown in Equation 8 can be re-arranged into Equation 11, where $x_{preset}$ is the preset effective distance for an agitator, E is an experience parameter, g is the gravitational constant, $\rho_0$ is a drill pipe density, $\rho_f$ is a fluid density, $C_0$ is the speed of sound in a drill pipe, $\mu_k$ is a kinetic friction coefficient, $a_0$ is the acceleration amplitude of the agitator, and $\omega$ is the frequency of the agitator, as previously described:

$$\omega = E\frac{2\rho_o C_0 a_0}{\pi x_{preset} g \mu_k (\rho_o - \rho_f)} \tag{11}$$

For example, as shown in Equation 11, if the experiencer parameter is 1.0, drill pipe density $\rho_0$ is 8000 kg/m$^3$, the speed of sound in the drill pipe $C_0$ is 6000 m/s, the acceleration amplitude of the agitator $a_0$ is 1 m/s$^2$, the preset effective distance for an agitator is 50 m, the gravitational constant g is 9.8 N/m, the kinetic friction coefficient $\mu_k$ is 0.4, the fluid density $\rho_f$ is 2000 kg/m$^3$, the agitator frequency can be determined to be $\omega$=25.98 s$^{-1}$. In some embodiments, the fluid flow rate associated with an agitator frequency can be determined by using a data table or correlation function associated with the agitator. For example, an agitator frequency of 25.98 s$^{-1}$ can be correlated with a fluid pump rate of 6.5 barrels per minute.

At block 916, a borehole is drilled based on the determined operational parameters. The determined operational parameters can be any parameter that can either be directly or indirectly controlled during a drilling operation. In some embodiments, the determined operational parameters can include fluid flow rate. For example, with respect to FIG. 1, if the determined operational parameter is a fluid flow rate of 6.5 barrels per minute, then the pump 150 can be operated to set the fluid flow rate to 6.5 barrels per minute. In some embodiments, controlling the drilling operations can also include changing the mud density, which would influence the fluid density and thus influence effective distance. After drilling the borehole based on the determined operational parameters, operations of the flowchart 900 are complete.

Example Computer Device

Figure 10:
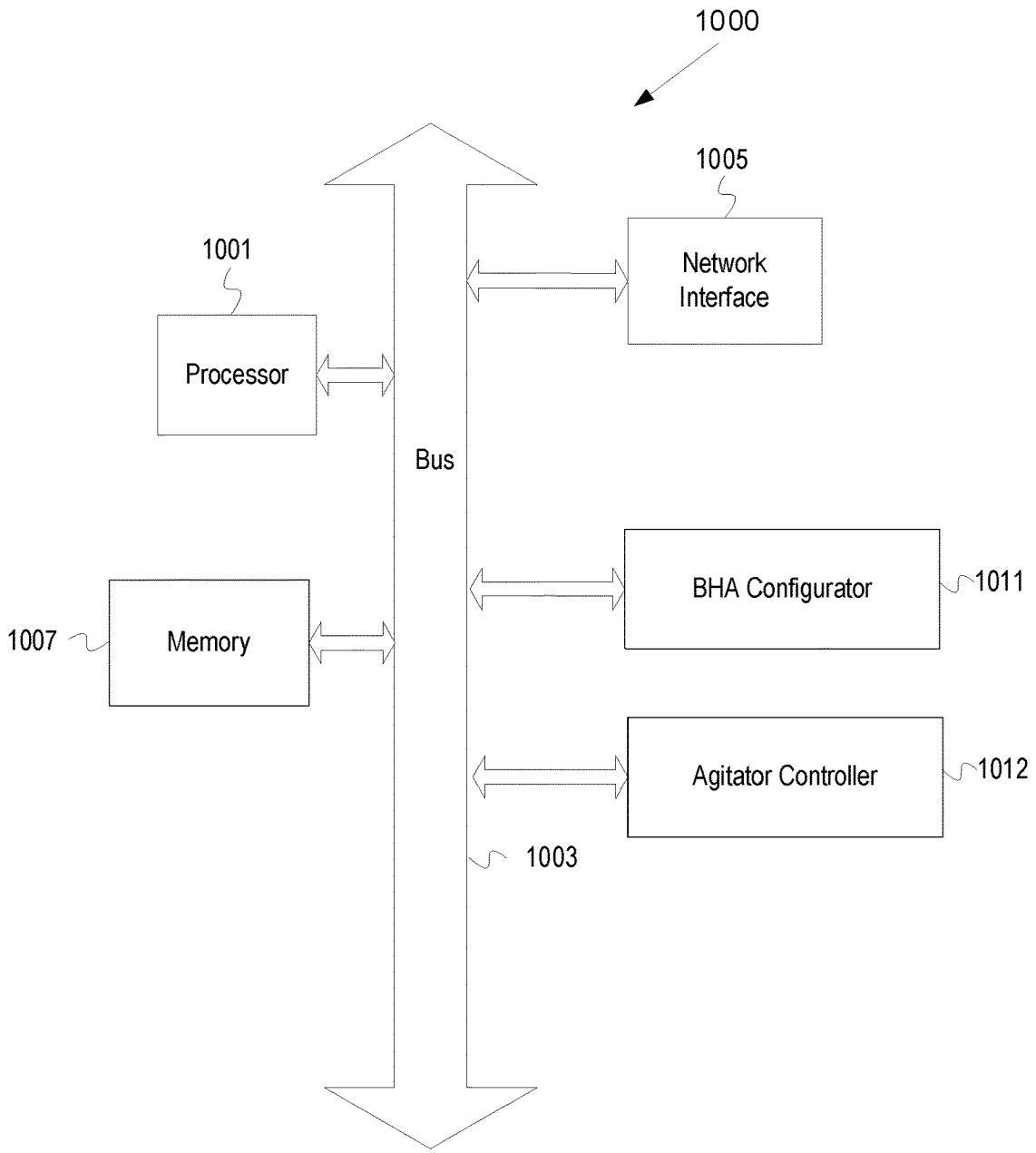
FIG. 10 depicts an example computer device, according to some embodiments.

FIG. 10 depicts an example computer device, according to some embodiments. A computer device 1000 includes a processor 1001 (possibly including multiple processors, multiple cores, multiple nodes, and/or implementing multi-threading, etc.). The computer device 1000 includes a memory 1007. The memory 1007 can be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer device 1000 also includes a bus 1003 (e.g., PCI, ISA, PCI-Express, HyperTransport® bus, InfiniBand® bus, NuBus, etc.) and a network interface 1005 (e.g., a Fiber Channel interface, an Ethernet interface, an internet small computer system interface, SONET interface, wireless interface, etc.).

In some embodiments, the computer device 1000 includes a BHA configurator 1011 and an agitator controller 1012. The BHA configurator 1011 can perform one or more operations for configuring a BHA, including determining distances between agitators of the BHA (as described above). The agitator controller 1012 can perform one or more operations for controlling the agitators during drilling (as described above). Any one of the previously described functionalities can be partially (or entirely) implemented in hardware and/or on the processor 1001. For example, the functionality can be implemented with an application specific integrated circuit, in logic implemented in the processor 1001, in a co-processor on a peripheral device or card, etc. Further, realizations can include fewer or additional components not illustrated in FIG. 10 (e.g., video cards, audio cards, additional network interfaces, peripheral devices, etc.). The processor 1001 and the network interface 1005 are coupled to the bus 1003. Although illustrated as being coupled to the bus 1003, the memory 1007 can be coupled to the processor 1001. The computer device 1000 can be integrated into component(s) of the drill pipe downhole and/or be a separate device at the surface that is communicatively coupled to the BHA downhole for controlling and processing signals (as described herein).

As will be appreciated, aspects of the disclosure can be embodied as a system, method or program code/instructions stored in one or more machine-readable media. Accordingly, aspects can take the form of hardware, software (including firmware, resident software, micro-code, etc.), or a combination of software and hardware aspects that can all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) can be utilized. The machine-readable medium can be a machine-readable signal medium or a machine-readable storage medium. A machine-readable storage medium can be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium can be any tangible medium that can contain, or store a program for use by or in connection with an instruction execution system, apparatus, or device. A machine-readable storage medium is not a machine-readable signal medium.

A machine-readable signal medium can include a propagated data signal with machine readable program code embodied therein, for example, in baseband or as part of a carrier wave. Such a propagated signal can take any of a variety of forms, including, but not limited to, electromagnetic, optical, or any suitable combination thereof. A machine-readable signal medium can be any machine readable medium that is not a machine-readable storage medium and that can communicate, propagate, or transport a program for use by or in connection with an instruction execution system, apparatus, or device.

Program code embodied on a machine-readable medium can be transmitted using any appropriate medium, including but not limited to wireless, wireline, optical fiber cable, RF, etc., or any suitable combination of the foregoing.

Computer program code for carrying out operations for aspects of the disclosure can be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code can execute entirely on a stand-alone machine, can execute in a distributed manner across multiple machines, and can execute on one machine while providing results and or accepting input on another machine.

The program code/instructions can also be stored in a machine-readable medium that can direct a machine to function in a particular manner, such that the instructions stored in the machine-readable medium produce an article of manufacture including instructions which implement the function/act specified in the flowchart and/or block diagram block or blocks.

Variations

Plural instances can be provided for components, operations or structures described herein as a single instance. Finally, boundaries between various components, operations and data stores are somewhat arbitrary, and particular operations are illustrated in the context of specific illustrative configurations. Other allocations of functionality are envisioned and can fall within the scope of the disclosure. In general, structures and functionality presented as separate components in the example configurations can be implemented as a combined structure or component. Similarly, structures and functionality presented as a single component can be implemented as separate components. These and other variations, modifications, additions, and improvements can fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

Example embodiments include the following:

Embodiment 1: A method comprising: determining a property of a first section of drill pipe that is to connect a first agitator to a second agitator in a bottom hole assembly of a drill string; determining a distance between the first agitator and the second agitator based, at least in part, on the property of the first section of drill pipe; positioning the first agitator in the bottom hole assembly of the drill string; and positioning the second agitator in the bottom hole assembly of the drill string relative to the first agitator based, at least in part, on the distance.

Embodiment 2: The method of Embodiment 1, further comprising: determining a kinetic friction coefficient between the first section of drill pipe and a formation sidewall of a borehole being drilled by the drill string; determining a property of a drilling fluid flowing through the drill string during drilling of the borehole, wherein determining the distance comprises determining the distance based, at least in part, on the kinetic friction coefficient and the property of the drilling fluid; assembling the bottom hole assembly based, at least in part, on the positioning of the first agitator and the second agitator; and drilling the borehole with a drill bit of the bottom hole assembly of the drill string, wherein drilling the borehole comprises, activating the first agitator and the second agitator while the first agitator and the second agitator are in a non-vertical portion of the borehole.

Embodiment 3: The method of Embodiment 1 or 2, wherein activating the first agitator comprises operating the first agitator at a first amplitude of acceleration and a first frequency based, at least in part, on the distance.

Embodiment 4: The method of any of Embodiments 1-3, wherein activating the second agitator comprises operating the second agitator at a second amplitude of acceleration and a second frequency based, at least in part, on the distance.

Embodiment 5: The method of any of Embodiments 1-4, further comprising determining a kinetic friction coefficient between the first section of drill pipe and a formation sidewall of a borehole being drilled by the drill string, wherein determining the distance comprises determining the distance based, at least in part, on the kinetic friction coefficient.

Embodiment 6: The method of any of Embodiments 1-5, further comprising: determining a property of a drilling fluid flowing through the drill string during drilling of a borehole; and determining a static friction coefficient between the first section of drill pipe and a formation sidewall of a borehole being drilled by the drill string, wherein determining the distance comprises determining the distance based, at least in part, on the property of the drilling fluid and the static friction coefficient.

Embodiment 7: The method of any of Embodiments 1-6, wherein determining the distance is based, at least in part, on, a flow rate of a drilling fluid through the first agitator and the second agitator during drilling of a borehole by the drill string.

Embodiment 8: The method of any of Embodiments 1-7, further comprising: determining a property of a second section of drill pipe that is to connect the first agitator to a drill bit in the bottom hole assembly of the drill string; and determining a distance between the first agitator and the drill bit based, at least in part, on the property of the second section of drill pipe.

Embodiment 9: One or more non-transitory machine-readable media comprising program code, the program code to: determine a property of a first section of drill pipe that is to connect a first agitator to a second agitator in a bottom hole assembly of a drill string; determine a distance between the first agitator and the second agitator based, at least in part, on the property of the first section of drill pipe; and generate a model of the bottom hole assembly based, at least in part, on the distance between the first agitator and the second agitator.

Embodiment 10: The one or more non-transitory machine-readable media of any of Embodiment 9, wherein the program code further comprises program code to: determine a kinetic friction coefficient between the first section of drill pipe and a formation sidewall of a borehole to be drilled by the drill string, wherein the distance is based, at least in part, on the kinetic friction coefficient.

Embodiment 11: The one or more non-transitory machine-readable media of Embodiment 9 or 10, wherein the program code further comprises program code to: determine a property of a drilling fluid to flow through the drill string during drilling of a borehole, wherein the distance is based, at least in part, on, the property of the drilling fluid.

Embodiment 12: The one or more non-transitory machine-readable media of any of Embodiments 9-11, wherein the distance is based, at least in part, on, a flow rate of a drilling fluid through the first agitator and the second agitator during drilling of a borehole by the drill string.

Embodiment 13: The one or more non-transitory machine-readable media of any of Embodiments 9-12, wherein the model comprises a first agitator position, a second agitator position, and a drill bit position.

Embodiment 14: The one or more non-transitory machine-readable media of any of Embodiments 9-13, wherein the program code further comprises program code to: determine a property of a second section of drill pipe that is to connect the first agitator to a drill bit in the bottom hole assembly of the drill string; and determine a distance between the first agitator and the drill bit based, at least in part, on the property of the second section of drill pipe.

Embodiment 15: The one or more non-transitory machine-readable media of any of Embodiments 9-14, wherein the model is based, at least in part, on the distance between the first agitator and the drill bit in the bottom hole assembly of the drill string.

Embodiment 16: A system comprising: a drill string having a bottom hole assembly that comprises, a first agitator; a second agitator connected to the first agitator with a first section of drill pipe; and a drill bit to drill a borehole; a processor; and a machine-readable medium having program code executable by the processor to cause the processor to, determine a property of a drilling fluid that is to flow through the drill string during drilling of the borehole; determine a distance between the first agitator and the second agitator based, at least in part, on the property of the drilling fluid; and generate a model of the bottom hole assembly based, at least in part, on the distance between the first agitator and the second agitator.

Embodiment 17: The system of Embodiment 16, wherein the first agitator is to operate, in a non-vertical portion of the borehole, at a first amplitude of acceleration and a first frequency based, at least in part, on the distance, and wherein the second agitator is to operate, in a non-vertical portion of the borehole, at a second amplitude of acceleration and a second frequency based, at least in part, on the distance.

Embodiment 18: The system of Embodiment 16 or 17, wherein the program code executable by the processor further comprises program code to: determine a kinetic friction coefficient between the first section of drill pipe and a formation sidewall of the borehole, wherein the distance is based, at least in part, on the kinetic friction coefficient.

Embodiment 19: The system of any of Embodiments 16-18, wherein the distance between the first agitator and the second agitator is based, at least in part, on a flow rate of the drilling fluid through the first agitator and the second agitator during drilling of the borehole by the drill string.

Embodiment 20: The system of any of Embodiments 16-19, wherein the program code executable by the processor further comprises program code to cause the processor to: determine a property of a second section of drill pipe that is to connect the first agitator to the drill bit in the bottom hole assembly of the drill string; and determine a distance between the first agitator and the drill bit based, at least in part, on the property of the second section of drill pipe.

What is claimed is:

1. A method comprising:

determining, with a first effective distance model, a first effective distance and a second effective distance respectively fora first agitator and a second agitator, wherein the first effective distance model determines at least one of the first and second effective distances at least based on agitator frequency, drill pipe density, fluid density, and agitator acceleration amplitude; and determining positions of a plurality of bottom hole assembly components based, at least partly, on at least one of the first and second effective distances, wherein the plurality of bottom hole assembly components at least includes the first agitator and the second.

2. The method of claim 1, further comprising:

drilling a borehole with a drill bit of the bottom hole assembly, wherein drilling the borehole comprises, activating the first agitator and the second agitator while the first agitator and the second agitator are in a non-vertical portion of the borehole.

3. The method of claim 2, wherein activating the first agitator comprises operating the first agitator at a first agitator acceleration amplitude and a first agitator frequency based, at least in part, on the first effective distance.

4. The method of claim 2, wherein activating the second agitator comprises operating the second agitator at a second agitator acceleration amplitude and a second agitator frequency based, at least in part, on the second effective distance.

5. The method of claim 1, further comprising:

determining a kinetic friction coefficient between a first section of drill pipe and a formation sidewall of a borehole, wherein the first effective distance model determines effective distance also based, at least in part, on the kinetic friction coefficient.

6. The method of claim 1, further comprising:

selecting the first effective distance model from a plurality of effective distance models depending on whether a primary design criterion for the bottom hole assembly relates to maximum vibration speed, maximum stress wave force, or average vibration speed.

7. The method of claim 6, further comprising:

based on a determination that a maximum stress wave force generated by the first agitator is to be greater than a static friction force at a limit of the first effective distance, determining that the primary design criterion relates to maximum stress wave force; and determining a static friction coefficient between a first section of drill pipe and a formation sidewall of a borehole, wherein the first effective distance model also determines the first effective distance based, at least in part, on the static friction coefficient and a density of the first section of drill pipe.

8. The method of claim 1, wherein the first effective distance model also determines effective distance based, at least in part, on, a flow rate of a drilling fluid that is to flow through the first agitator and the second agitator during drilling.

9. The method of claim 1, further comprising:

determining a property of a section of drill pipe that is to connect the first agitator to a drill bit in the bottom hole assembly, wherein the first effective distance model also determines the first effective distance based, at least in part, on the property of the section of drill pipe.

10. One or more non-transitory machine-readable media comprising program code, the program code to:

determine, with a first effective distance model, a first effective distance for a first agitator of a plurality of agitators wherein the first effective distance model determines effective distance at least based on agitator frequency, drill pipe density, fluid density, and agitator acceleration amplitude;

determine positions of a plurality of bottom hole assembly components based, at least partly, on the first effective distance, wherein the plurality of bottom hole assembly components includes the first agitator and a second agitator of the plurality of agitators; and generate a model of the bottom hole assembly based, at least in part, on the determined positions, wherein the bottom hole assembly includes the plurality of bottom hole assembly components.

11. The one or more non-transitory machine-readable media of claim 10, wherein the program code further comprises program code to:

determine a kinetic friction coefficient between a first section of drill pipe and a formation sidewall of a borehole, wherein the first effective distance model also determines effective distance based, at least in part, on the kinetic friction coefficient.

12. The one or more non-transitory machine-readable media of claim 10, wherein the plurality of bottom hole assembly components further comprises a drill bit.

13. The one or more non-transitory machine-readable media of claim 10, wherein the program code further comprises program code to:

select the first effective distance model from a plurality of effective distance models depending on whether a primary design criterion for the bottom hole assembly relates to maximum vibration speed, maximum stress wave force, or average vibration speed.

14. A system comprising:

a drill string having a bottom hole assembly that comprises, a first agitator;

a second agitator;

a first section of drill pipe; and a drill bit;

a processor; and a machine-readable medium having program code executable by the processor to cause the processor to, determine, with a first effective distance model, a first effective distance for the first agitator, wherein the first effective distance model determines effective distance at least based on agitator frequency, drill pipe density, fluid density, and agitator acceleration amplitude; and cause a controller to operate, during drilling of a borehole, at least one of the first agitator and the second agitator of the bottom hole assembly based, at least in part, on the first effective distance.

15. The system of claim 14, wherein the program code executable by the processor to cause the controller to operate at least one of the first agitator and the second agitator of the bottom hole assembly comprises program code to cause the controller to:

operate the first agitator, in a non-vertical portion of the borehole, at a first agitator acceleration amplitude and a first agitator frequency based, at least in part, on the first effective distance; and operate the second agitator, in the non-vertical portion of the borehole, at a second agitator acceleration amplitude and a second agitator frequency based, at least in part, on the first effective distance.

16. The system of claim 14, wherein the program code executable by the processor further comprises program code to cause the controller to flow a drilling fluid through the first agitator and the second agitator during drilling of the borehole at a flow rate based on the first effective distance.

17. The system of claim 14, wherein the program code executable by the processor further comprises program code to cause the processor to:

determine a property of a second section of drill pipe that is to connect the first agitator to the drill bit in the bottom hole assembly of the drill string; and determine a position for the first agitator based, at least in part, on the property of the second section of drill pipe and the first effective distance.

18. The system of claim 14, wherein the program code executable by the processor further comprises program code to cause the processor to:

determine positions for the first agitator and the second agitator based, at least in part, on the first effective distance.

19. The system of claim 14, wherein the program code executable by the processor further comprises program code to cause the processor to:

select the first effective distance model from a plurality of effective distance models depending on whether a primary design criterion for the bottom hole assembly relates to maximum vibration speed, maximum stress wave force, or average vibration speed.

20. The system of claim 19, wherein the program code executable by the processor to cause the processor to select the first effective distance model from a plurality of effective distance models comprises program code to cause the processor to:

determine the primary design criterion based on a maximum condition at a limit of the first effective distance, wherein, if the condition is a maximum vibration speed greater than zero at the limit of the first effective distance, the primary design criterion is determined to relate to maximum vibration speed, and wherein, if the condition is a maximum stress wave force greater than a static friction force at the limit of the first effective distance, the primary design criterion is determined to relate to maximum stress wave force.

* * * * *